US009039161B2

(12) United States Patent
Itogawa

(10) Patent No.: US 9,039,161 B2
(45) Date of Patent: May 26, 2015

(54) LIQUID EJECTION APPARATUS INCLUDING CURL REDUCTION DEVICE, CURL REDUCTION METHOD EXECUTED IN THE APPARATUS, AND STORAGE MEDIUM USED FOR THE APPARATUS

(71) Applicant: BROTHER KOGYO KABUSHIKI KAISHA, Nagoya-shi, Aichi-ken (JP)

(72) Inventor: Yoshihiro Itogawa, Mizuho (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/852,188

(22) Filed: Mar. 28, 2013

(65) Prior Publication Data

US 2013/0257961 A1 Oct. 3, 2013

(30) Foreign Application Priority Data

Mar. 30, 2012 (JP) ..... 2012-079450

(51) Int. Cl.
*B41J 29/38* (2006.01)
*B41J 11/00* (2006.01)
*B41J 13/00* (2006.01)

(52) U.S. Cl.
CPC ..... *B41J 11/0005* (2013.01); *B41J 11/002* (2013.01); *B41J 13/0036* (2013.01)

(58) Field of Classification Search
USPC ..... 347/5, 9, 102, 16; 399/21
See application file for complete search history.

(56) References Cited

U.S. PATENT DOCUMENTS

| | | | | |
|---|---|---|---|---|
| 6,244,700 | B1 | 6/2001 | Kimura et al. | |
| 2008/0298821 | A1 * | 12/2008 | Mori | 399/21 |
| 2009/0073211 | A1 | 3/2009 | Imoto | |
| 2009/0147039 | A1 | 6/2009 | Koase | |
| 2012/0050363 | A1 | 3/2012 | Nagashima | |

FOREIGN PATENT DOCUMENTS

| | | | |
|---|---|---|---|
| CN | 1249997 | A | 4/2000 |
| CN | 102381028 | A | 3/2012 |

(Continued)

OTHER PUBLICATIONS

European Patent Office, Extended European Search Report for European Patent Application No. 13161419.0 (counterpart to above-captioned patent application), mailed Aug. 6, 2013.

(Continued)

*Primary Examiner* — Lam S Nguyen
(74) *Attorney, Agent, or Firm* — Merchant & Gould PC

(57) ABSTRACT

A liquid ejection apparatus includes: (a) a storage device for storing an image data set representing a plurality of images; (b) a liquid ejection head for performing an image formation on each recording medium; (c) a curl reduction device for reducing curl caused in each recording medium having the corresponding image formed thereon by the liquid ejection head; (d) an output tray for receiving each recording medium whose curl has been reduced by the curl reduction device, such that the received recording media are stacked on the output tray; and (e) a control device configured to control the curl reduction device, such that the curl caused in an earlier one of the recording media is reduced by a smaller degree than the curl caused in a later one of the recording media that has been subjected to the image formation later than the earlier one of the recording media.

10 Claims, 10 Drawing Sheets

(56) References Cited

FOREIGN PATENT DOCUMENTS

| | | | |
|---|---|---|---|
| JP | 2009-066905 | A | 4/2009 |
| JP | 2009-143010 | A | 7/2009 |

OTHER PUBLICATIONS

Office Action issued in related Chinese patent application No. 201310102237.6, dated Jan. 22, 2015.

* cited by examiner

| PAGE NUMBER | WAITING TIME |
|---|---|
| 1 | 0.5 sec |
| 2 | 0.6 sec |
| 3 | 0.7 sec |
| 4 | 0.8 sec |
| ⋮ | |

T0

| | T1 FIRST TABLE | T2 SECOND TABLE |
|---|---|---|
| PAGE NUMBER | WAITING TIME | WAITING TIME |
| 1 | 0.5 sec | 0.7 sec |
| 2 | 0.6 sec | 0.8 sec |
| 3 | 0.7 sec | 0.9 sec |
| 4 | 0.8 sec | 1.0 sec |
| ⋮ | | |

FIG.8

(a) BLACK

| | a | b | c | d | e | f |
|---|---|---|---|---|---|---|
| 1 | | | M | M | M | |
| 2 | | | M | | | |
| 3 | | L | M | | | |
| 4 | | | | | | |
| 5 | | | | | | |
| 6 | | | | | | |

(b) CYAN

| | a | b | c | d | e | f |
|---|---|---|---|---|---|---|
| 1 | | | | | | |
| 2 | | | | | | |
| 3 | | | | | | |
| 4 | | M | | | | |
| 5 | | L | M | | | |
| 6 | | | | | | |

(c) MAGENTA

| | a | b | c | d | e | f |
|---|---|---|---|---|---|---|
| 1 | | | | | | |
| 2 | | | | | | |
| 3 | | | | | | |
| 4 | | | | | S | |
| 5 | | | | L | M | |
| 6 | | M | S | M | | |

(d) YELLOW

| | a | b | c | d | e | f |
|---|---|---|---|---|---|---|
| 1 | | | | | | |
| 2 | | | | S | S | |
| 3 | | | | S | S | |
| 4 | | S | | S | S | |
| 5 | | L | M | S | M | |
| 6 | | | | | | |

SHEET CONVEYANCE DIRECTION

FIG.10

FOURTH EMBODIMENT

LIQUID EJECTION APPARATUS INCLUDING CURL REDUCTION DEVICE, CURL REDUCTION METHOD EXECUTED IN THE APPARATUS, AND STORAGE MEDIUM USED FOR THE APPARATUS

CROSS REFERENCE TO RELATED APPLICATION

This application claims priority from Japanese Patent Application No. 2012-079450 filed on Mar. 30, 2012, the disclosure of which is herein incorporated by reference in its entirety.

BACKGROUND OF THE INVENTION

1. Field of the Invention

The present invention relates to a liquid ejection apparatus including a liquid ejection head and a curl reduction device that is configured to reduce curl of a recording medium after formation of an image on the recording medium by the liquid ejection head. The present invention relates also to a curl reduction method that is to be executed in the liquid ejection apparatus, and a storage medium storing a control program for executing the curl reduction method.

2. Discussion of Related Art

There is known an inkjet recording apparatus for recording an image on a sheet-like recording medium such as a paper or film by ejecting ink toward the recording medium. As the ink used for such an inkjet recording apparatus, there is one containing water as a solvent. Due to moisture contained in the ink, there is a case where curl is caused in each of the recording media which has received the ink, after formation of the images on the recording medium. If an amount of the curl is larger than a certain amount, the recording media are not neatly stacked on an output tray, thereby causing problem such as folding or bending of each of the recording media. In connection with such a problem, there is known an inkjet recording apparatus in which a size of curl (hereinafter referred to as "curl amount") that is to be caused in a recording medium after formation of an image on the recording medium, is estimated, and a waiting time is determined depending on the estimated curl amount. That is, in this inkjet recording apparatus, the recording medium is discharged to an output tray upon elapse of the determined waiting time after the formation of the image. The waiting time is a length of time that is large enough to straighten the recording medium so as to cause the curl amount to be smaller than a certain amount.

SUMMARY OF THE INVENTION

In the above-described inkjet recording apparatus, however, the recording medium is not discharged until the above-described waiting time has elapsed after the formation of the image. Therefore, where there are a plurality of recording media that are to be successively subjected to formations of respective images, every one of the plurality of recording media is not discharged until the above-described waiting time has elapsed, so that there is a problem that increases a throughput time, namely, increases a length of time required to complete discharge of all of the recording media after the formations of the images. It might be possible to reduce this required length of time, for example, by causing each of the recording media to be discharged before elapse of the above-described waiting time. However, in this case, since each of the recording media is discharged upon elapse of an insufficient length of time, it is likely that the curl amount of each of the discharged recording media becomes larger than the certain amount, thereby causing the above-described problem such as folding or bending of each recording medium.

It is therefore an object of the invention to reduce a curl amount of each of recording media where the recording media are successively subjected to formations of respective images and then are successively discharged, and accordingly to reduce a length of time required to complete discharge of all of the recording media after the formations of the images.

A liquid ejection apparatus according to the present invention includes: (a) a storage device configured to store therein an image data set representing a plurality of images that are to be formed on a plurality of recording media; (b) a liquid ejection head configured to perform an image formation on each of the plurality of recording media, so as to form, on the recording media, the respective images represented by the image data set that is stored in the storage device; (c) a curl reduction device configured to reduce curl caused in each of the recording media having a corresponding one of the images that has been formed thereon by the liquid ejection head; (d) an output tray configured to receive therein each of the recording media whose curl has been reduced by the curl reduction device, such that the received recording media are stacked on the output tray; and (e) a control device configured to control the curl reduction device, such that the curl caused in an earlier one of the recording media is reduced by a smaller degree than the curl caused in a later one of the recording media that has been subjected to the image formation later than the earlier one of the recording media.

The number of the recording media that are to be superposed on the above-described later one of the recording media, is smaller than the number of recording media that are to be superposed on the above-described earlier one of the recording media, because the later one of the recording media is subjected to the image formation later than the earlier one of the recording media and is discharged to the output tray later than the earlier one of the recording media. Therefore, the curl of the later one of the recording media is more difficult to be reduced, as compared with the curl of the earlier one of the recording media. Further, a length of time from since the recording medium is discharged to the output tray until an user picks up the recording medium stacked on the output tray, is shorter in case of the later one of the recording media than in case of the earlier one of the recording media. This is also a factor that makes it more difficult to reduce the curl of the later one of the recording media. In the liquid ejection apparatus according to the present invention, the curl caused in the later one of the recording media is reduced by a larger degree than the curl caused in the earlier one of the recording media, so that an amount of remaining curl is intended to be smaller in the later one of the recording media than in the earlier one of the recording media.

BRIEF DESCRIPTION OF THE DRAWINGS

FIG. 8 is a view showing first and second tables.

FIG. 10 is a set of views showing data of ejection of each color ink.

DETAILED DESCRIPTION OF THE PREFERRED EMBODIMENTS

There will be described preferred embodiments of the present invention, with reference to the drawings. In the preferred embodiments, the recording medium is constituted, by way of example, a paper sheet P, and the liquid ejection apparatus is constituted, by way of example, an inkjet recording apparatus that is configured to eject, toward the paper sheet P, inks containing water as a solvent.

[Overall Construction of Inkjet Recording Apparatus]

Figure 1:
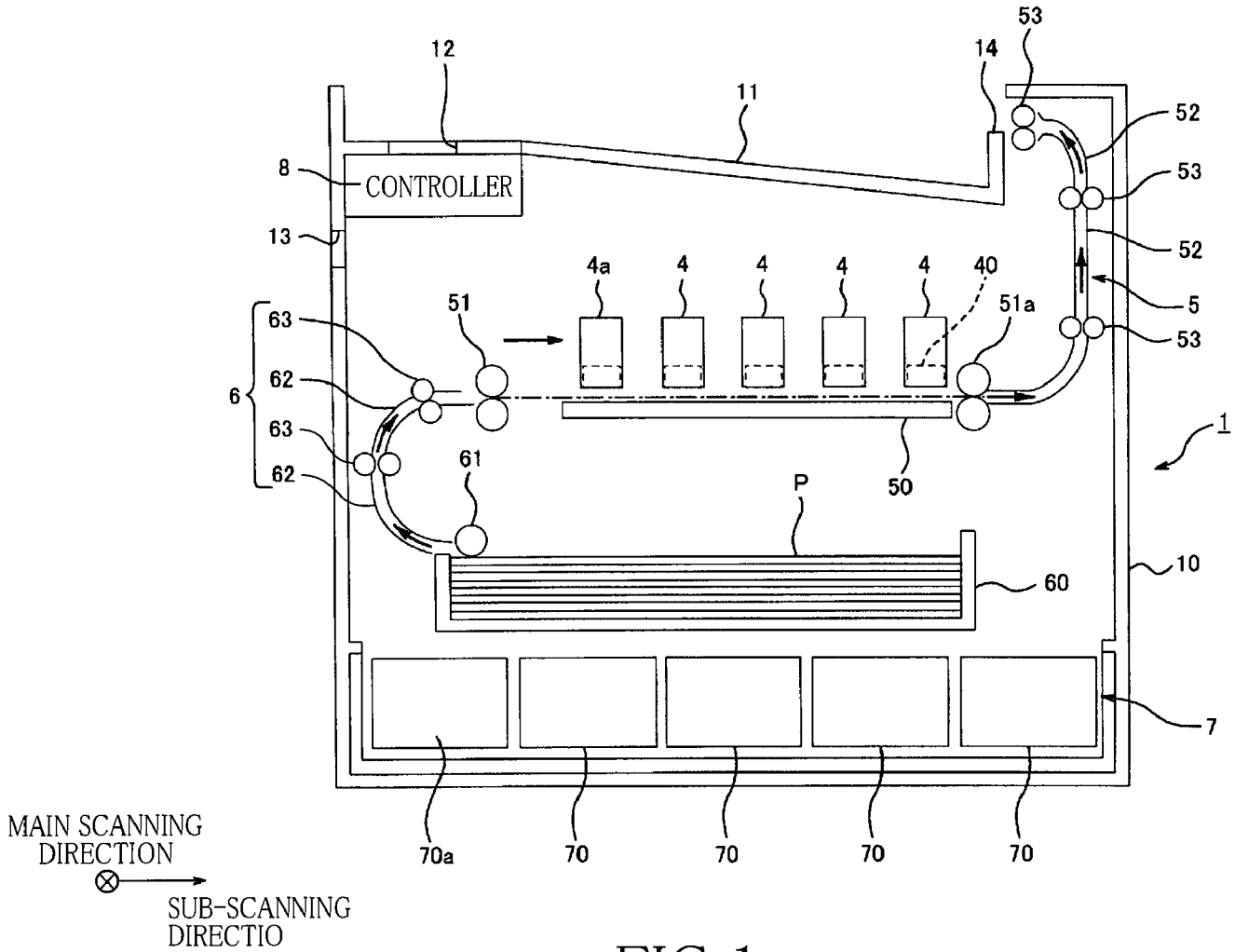
FIG. 1 is a view showing an overall construction of an inkjet recording apparatus.

FIG. 1 is a view showing an overall construction of the inkjet recording apparatus 1. This inkjet recording apparatus 1 includes a rectangular parallelepiped housing body 10. An exit tray 11 as an output tray is provided in an upper portion of the housing body 10, and is located on a lower side of an exit opening 14 that is also provided in the housing body 10. As described below, the exit tray 11 receives paper sheets P each of which has been subjected to a printing operation (i.e., image formation) and then discharged via the exit opening 14 such that the received paper sheets P are stacked to be stored on the exit tray 11. Inside the housing body 10, a plurality of liquid ejection heads 4, a sheet convey unit 5, a sheet supply unit 6 and a tank set 7 are arranged in this order of description as viewed in a direction from up to down. The liquid ejection head 4 is provided to eject droplets of black, cyan, magenta and yellow color inks toward each paper sheet P. The sheet convey unit 5 is provided to convey each paper sheet P in a horizontal direction and then convey the paper sheet P to the exit tray 11. The sheet supply unit 6 is provided to supply each paper sheet P to the sheet convey unit 5. The tank set 7 consists of a plurality of tanks 70 which stores therein respective color inks and which are arranged in the horizontal direction. On a downstream side of the sheet supply unit 6 and an upstream side of the plurality of liquid ejection heads 4, a processing liquid ejection head 4*a* is provided to eject a processing liquid toward each paper sheet P prior to ejections of the inks by the liquid ejection heads 4. The processing liquid is to be applied to each paper sheet P before the inks are ejected toward the paper sheet P, so as to aggregate or deposit components of the inks on the paper sheet P for thereby maintaining a high printing quality or improving an image quality. The tank set 7 includes a processing liquid tank 70*a* that stores therein the processing liquid.

Inside the housing body 10, there is also provided a controller 8. The controller 8 is located in an upper position that does not interfere with the liquid ejection heads 4, and is configured to control operations of various devices and electric circuits that are disposed inside the housing body 10. On a side surface of the housing body 10, a terminal 13 is disposed to be located on a lower side of the controller 8. The controller 8 receives, via the terminal 13, information supplied from an information recording device such as a personal computer that is located outside the housing body 10. As the supplied information, there is a print job so that the print job is inputted to the controller 8 via the terminal 13.

On an upper surface of the housing body 10, there is provided an operating panel 12 that is electrically connected to the controller 8. An user can input data relating to a bending strength of each paper sheet P, by operating the operating panel 12. The bending strength, which is referred also to as rigidity, varies depending on whether the paper sheet P is a thick paper sheet P or a thin paper sheet P. The curl amount of the paper sheet P, which has been subjected to printing operation, is dependent on the bending strength. Further, the bending strength varies depending on also a material of the paper sheet P. The user inputs the data relating to the bending strength of each paper sheet P by operating the operating panel 12, thereby making it possible to restrain or reduce the curl amount of each paper sheet P which has been subjected to printing operation and which is to be discharged to the exit tray 11.

The sheet convey unit 5 is a device configured to convey each paper sheet P in a direction from left to right as seen in FIG. 1. In the following description, a sub-scanning direction refers to a direction in which each paper sheet P is to be conveyed in a printing region while a main scanning direction refers to a direction that intersects with the sub-scanning direction on a horizontal plane.

The sheet convey unit 5 includes: a platen 50; a pair of conveying rollers 51 that are disposed on an upstream side, in a sheet conveyance direction, of the platen 50; a pair of conveying rollers 51*a* that are disposed on a downstream side, in the sheet conveyance direction, of the platen 50; a guide 52; and two pairs of discharging rollers 53. The guide 52 and the discharging rollers 53 are located between the exit tray 11 and the conveying rollers 51*a*. A conveyance force is applied to the paper sheet P from the conveying rollers 51 that are disposed on the upstream side of the platen 50, and the paper sheet P is conveyed while being supported on an upper surface of the platen 50. When having passed over the platen 50, the paper sheet P receives a conveyance force applied from the conveyance rollers 51*a* that are disposed on the downstream side of the platen 50. Then, the paper sheet P is conveyed to the exit tray 11 by the guide 52 and the discharging rollers 53.

The sheet supply unit 6 includes: a sheet supply tray 60; a sheet supplying roller 61; two guides 62; and two pairs of feeding rollers 63. The guides 62 and the feeding rollers 63 are located between the sheet supplying roller 61 and the sheet convey unit 5. The sheet supplying roller 61 picks up an uppermost one of the paper sheets P stored in the sheet supply tray 60, and the picked paper sheet P is conveyed onto an upstream side of the sheet convey unit 5 by the guides 62 and the feeding rollers 63.

Each of the liquid ejection heads 4 is a line head having a rectangular parallelepiped shape and elongated in the main scanning direction. Each liquid ejection head 4 has a lower surface that serves as a nozzle surface 40 in which a multiplicity of liquid ejection holes are formed so that ink can be ejected from the liquid ejection head 4 through the liquid ejection holes. The liquid ejection heads 4 are connected, via tubes (not shown), to respective tanks 70 storing therein respective color inks that are to be ejected from the liquid ejection heads 4. Each of the liquid ejection heads 4 is configured to eject the ink in the form of droplets, through the nozzles of the nozzle surface 40. It is noted that there are three sizes of droplets, i.e., large-sized droplet, medium-sized droplet and small-sized droplet, which are different in diameter from one another.

[Curl Reduction Device]

A part of the sheet convey unit 5 cooperates with a heater 20 (described below) to constitute a curl reduction device 2. If the curl amount of each paper sheet P, which has been subjected to printing operation, is not smaller than a certain amount, the discharged paper sheets P are not neatly stacked on the exit tray 11, thereby causing problem such as folding or bending of each paper sheet P. The curl reduction device 2 serves to reduce the curl amount of each paper sheet P to a certain amount or less, after the paper sheet P has been subjected to printing operation, before the paper sheet P is discharged to the exit tray 11.

Figure 2:
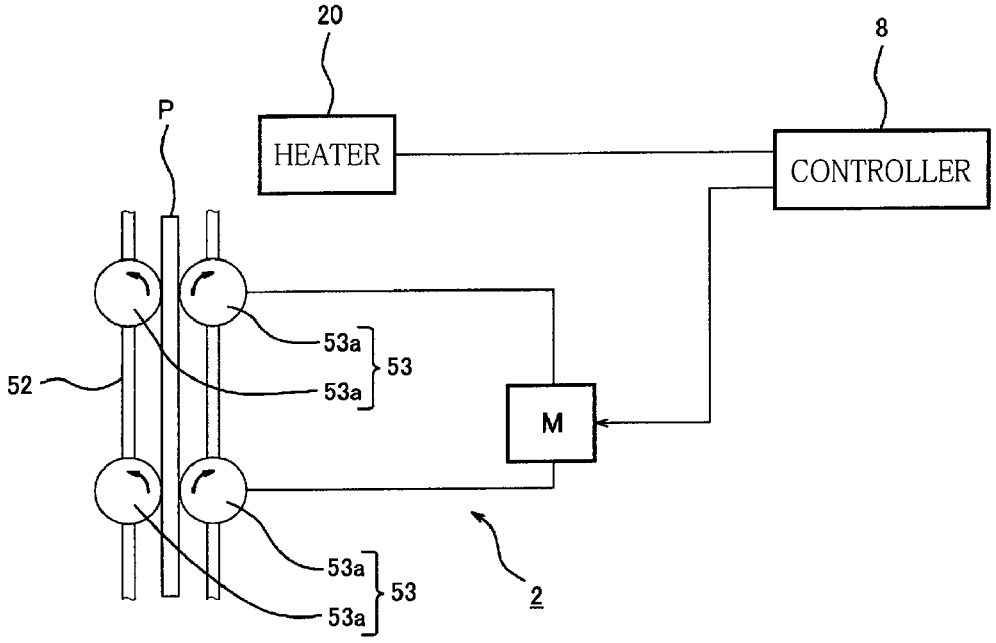
FIG. 2 is a view showing in detail a construction of a curl reduction device included in the inkjet recording apparatus of FIG. 1.

FIG. 2 is a view showing in detail a construction of the curl reduction device 2. Each pair of discharging rollers 53 consists of two discharging rollers 53*a* that are constantly forced toward each other. Each of the discharging rollers 53*a* is partially introduced, through a hole (not shown) that is formed through the guide 52, into a conveyance passage along which each paper sheet P is to be conveyed, so that each paper sheet can be conveyed by the two discharging rollers 53*a* while being gripped between the two discharging rollers 53*a*. The discharging rollers 53*a* are connected to a motor M, so as to be rotated by the motor M.

In a process in which each paper sheet P is conveyed by the discharging rollers 53*a* that grip the paper sheet P therebetween, the paper sheet P can be placed in its waiting state by stopping rotation of the motor M. When being placed in the waiting state, the paper sheet P is stopped in a certain position in the conveyance passage, and takes a posture extending straight vertically. That is, during the waiting state, the paper sheet P is caused to stay in the curl reduction device 2, while maintaining its shape. With the waiting state being kept for a given length of time, the inks on the paper sheet P are dried and the curl of the paper sheet P is removed or at least reduced. This given length of time, for which the waiting state is kept, is referred to as a waiting time. Thus, the curl of the paper sheet P having been subjected to printing operation can be removed or at least reduced, in other words, the shape of the paper sheet P can be substantially straightened or corrected, by causing the paper sheet P to wait for the waiting time so as to dry the inks on the paper sheet P.

Further, the curl of each paper sheet P can be reduced not only by stopping the printed paper sheet P in the certain position for the waiting time but also by conveying the paper sheet P at a low speed with the motor M being rotated at a low speed. This is because the inks on the paper sheet P can be dried while the paper sheet P is being conveyed at the low speed.

Still further, the heater 20 is disposed on a side of the discharging rollers 53*a*. The heater 20 is operated to emit heated air that is to be applied to the paper sheet P conveyed by the discharging rollers 53*a*, whereby the paper sheet P is heated. When the paper sheet P is being placed in the waiting state or is being conveyed at a low speed, the heated air emitted by the heater 20 is applied to the paper sheet P, for thereby facilitating drying of the paper sheet P. That is, the reduction of the curl amount of the paper sheet P is facilitated also by application of the heated air to the paper sheet P.

The motor M and the heater 20, which constitute the curl reduction device 2, are connected to the controller 8, as shown in FIG. 2. The motor M is controlled by the controller 8 so as to establish the above-described waiting time. The heater 20 is controlled by the controller 8 so as to establish a heating time and a heating temperature. The waiting time, heating time and heating temperature, which are set for the curl reduction device 2 to remove or reduce the curl of the paper sheet P, are referred to as curl reduction elements. As described above, the curl reduction device 2 serves to reduce the curl amount of the paper sheet P to a certain amount or less. The curl of the paper sheet P is corrected or reduced by a given degree which is referred to as a curl reduction degree. That is, the curl reduction degree refers to a degree of reduction by which the curl amount is reduced from a pre-reduced amount to a reduced amount (such as zero or a small amount).

It is noted that the curl reduction degree may refer to a difference between the curl amount (such as deflection amount) of the paper sheet P in an arrangement without means for reducing the curl and the curl amount in an arrangement with the means for reducing the curl, namely, a difference between the curl amount in the arrangement in which the paper sheet P is discharged to the exit tray 11 without reduction of the curl and the curl amount in the arrangement in which the paper sheet P is discharged after the curl has been reduced.

It is further noted that provision of the heater 20 in the curl reduction device 2 is not essential. That is, the curl of the paper sheet P may be reduced only by placing the paper sheet P in the waiting state or conveying the paper sheet P at a low speed, without application of the heated air to the paper sheet P.

[Internal Construction of Controller]

Figures 3A, 3B:
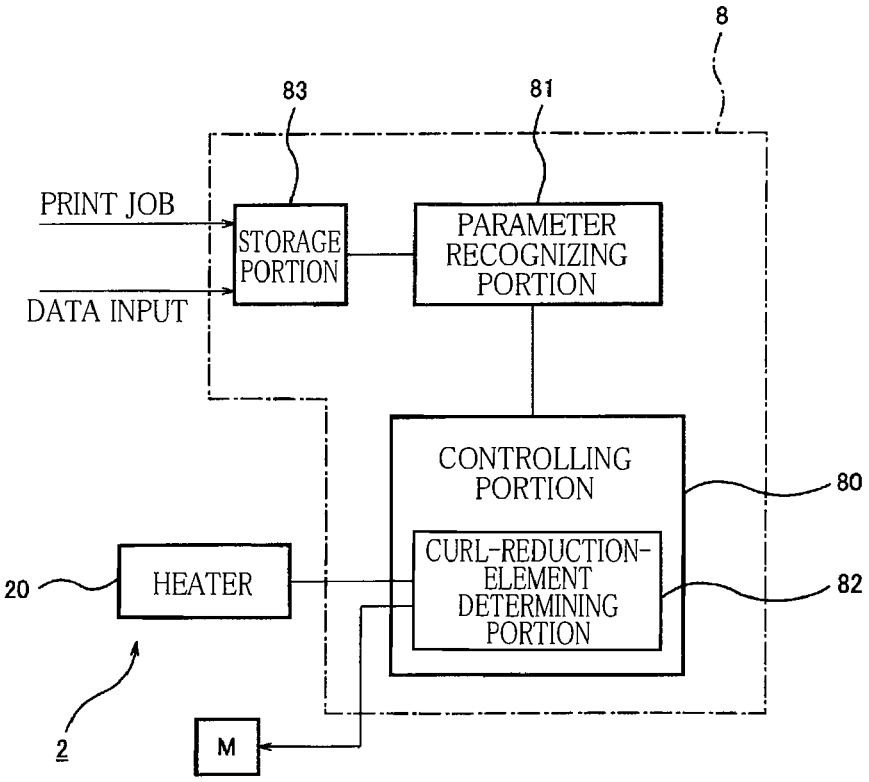
FIGS. 3A and 3B are block diagrams each showing an internal construction of a controller included in the inkjet recording apparatus of FIG. 1.

FIGS. 3A and 3B are block diagrams each showing an internal construction of the controller 8. The controller 8 is constituted mainly by a computer, and includes CPU (Central Processing Unit) 8A, ROM (Read Only Memory) 8B that stores programs or computer-readable instructions (that are to be executed by the CPU 8A as a processor) and data (that are to be used in the execution of the programs or computer-readable instructions) such that the stored programs (or instructions) and data are rewritable, RAM (Random Access Memory) 8C that temporarily stores the data in the execution of the programs (or instructions), and a nonvolatile memory 8D, as shown in FIG. 3A. The ROM 8B serves as a non-transitory computer-readable storage medium. The controller 8 is constituted by various functional portions that are established by cooperations of these hardwares with softwares stored in the ROM 8B.

As the functional portions of the controller 8, there are a controlling portion 80 as a control device, a parameter recognizing portion 81, a curl-reduction-element determining portion 82 and a storage portion 83 as a storage device, as shown in FIG. 3B. The storage portion 83 temporarily stores the print job and data inputted by the user through the operating panel 12. The parameter recognizing portion 81 receives the pint job and the inputted data that are supplied from the storage portion 83. The controlling portion 80 is connected to the parameter recognizing portion 81 and the curl reduction device 2, and includes the curl-reduction-element determining portion 82 that determines the waiting time for the curl reduction device 2.

The storage portion 83 may store a plurality of successive print jobs. The parameter recognizing portion 81 reads parameters contained in each print job or the data inputted by the user, and recognizes contents of the parameters. Further, the parameter recognizing portion 81 is capable of judging whether only one print job is stored in the storage portion 83 or a plurality of print jobs are stored in the storage portion 83. The controlling portion 80 controls ejecting operations of the liquid ejection heads 4, and causes the curl-reduction-element determining portion 82 to determine the curl reduction elements in accordance with the contents of the parameters that are recognized by the parameter recognizing portion 81.

Figures 4, 5:
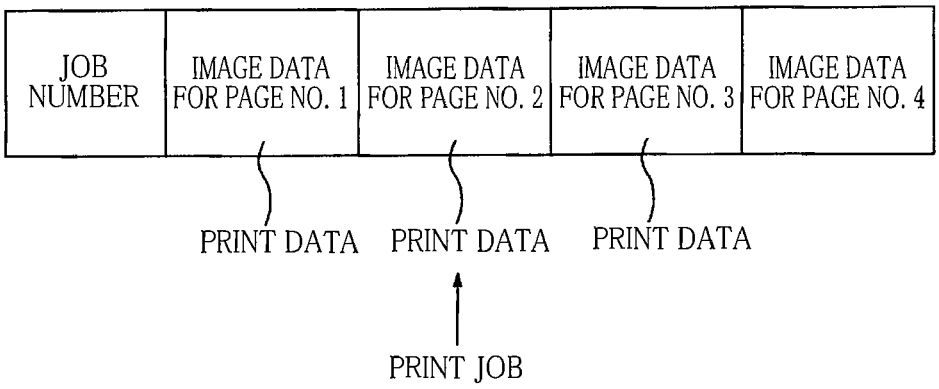
FIG. 4 is a view showing a content of a print job.
FIG. 5 is a view showing a waiting-time setting table.

FIG. 4 shows, by way of example, a format of the print job as an image-formation job, which contains a print data set that follows a data indicative of a job number. The print data set consists of a plurality of print data, each of which contains an image data and also a page number of a corresponding paper sheet that is to be subjected to an image formation performed based on the image data. Where a plurality of print data are contained in the print job, as in the example shown in FIG. 4, the print data are arranged from left to right in an order of the image formation. In the following description, a left end of the print job will be referred to as a front end while a right end of the print job will be referred to as a rear end. Thus, the print data containing a smaller page number is located to be close to the front end, while the print data containing a larger page number is located to be close to the rear end. That is, the image formation based on the print data containing a smaller page number is performed earlier than the image formation based on the print data containing a larger page number.

In the example shown in FIG. 4, since the print job contains a plurality of print data each of which contains an image data, it can be interpreted that the print job contains a image data set containing a plurality of image data. Each image data contains a flag and a vector image data, for example. The flag is indicative of whether the image is to be printed by a monochrome mode or a color mode. The vector image data is used for calculating sizes and quantity of the ink droplets to be ejected to a pixel area on the paper sheet P. That is, the sizes and quantity of the ejected ink droplets are estimated based on the vector image data. Further, there is a case when a plurality of print jobs are successively inputted to the parameter recognizing portion 81.

First Embodiment

In a case when a paper sheet P having been subjected to an image formation is discharged to the exit tray 11 and then a multiplicity of other paper sheets P are superposed on the paper sheet P, the curl of the paper sheet P is reduced owing to weights of the multiplicity of other paper sheets P. Therefore, in such a case, a small amount of the curl may remain in the paper sheet P on which the multiplicity of other paper sheets P will be superposed. On the other hand, in a case when a paper sheet P having been subjected to an image formation is discharged to the exit tray 11 and then only a small number of other paper sheets P are superposed on the paper sheet P, there is little effect that the curl of the paper sheet P is reduced by weights of the other paper sheets P. Therefore, in such a case, the paper sheet P is required to be discharged to the exit tray 11 after the curl amount has been reduced to a small amount by a high curl reduction degree. It is therefore preferable that the curl-reduction-element determining portion 82 is controlled to determine curl reduction elements such that the curl reduction elements vary depending on the number of paper sheets P that are to be superposed on the paper sheet P in question after the image formation performed on the paper sheet P in question.

[Operations of Controller]

Figure 6:
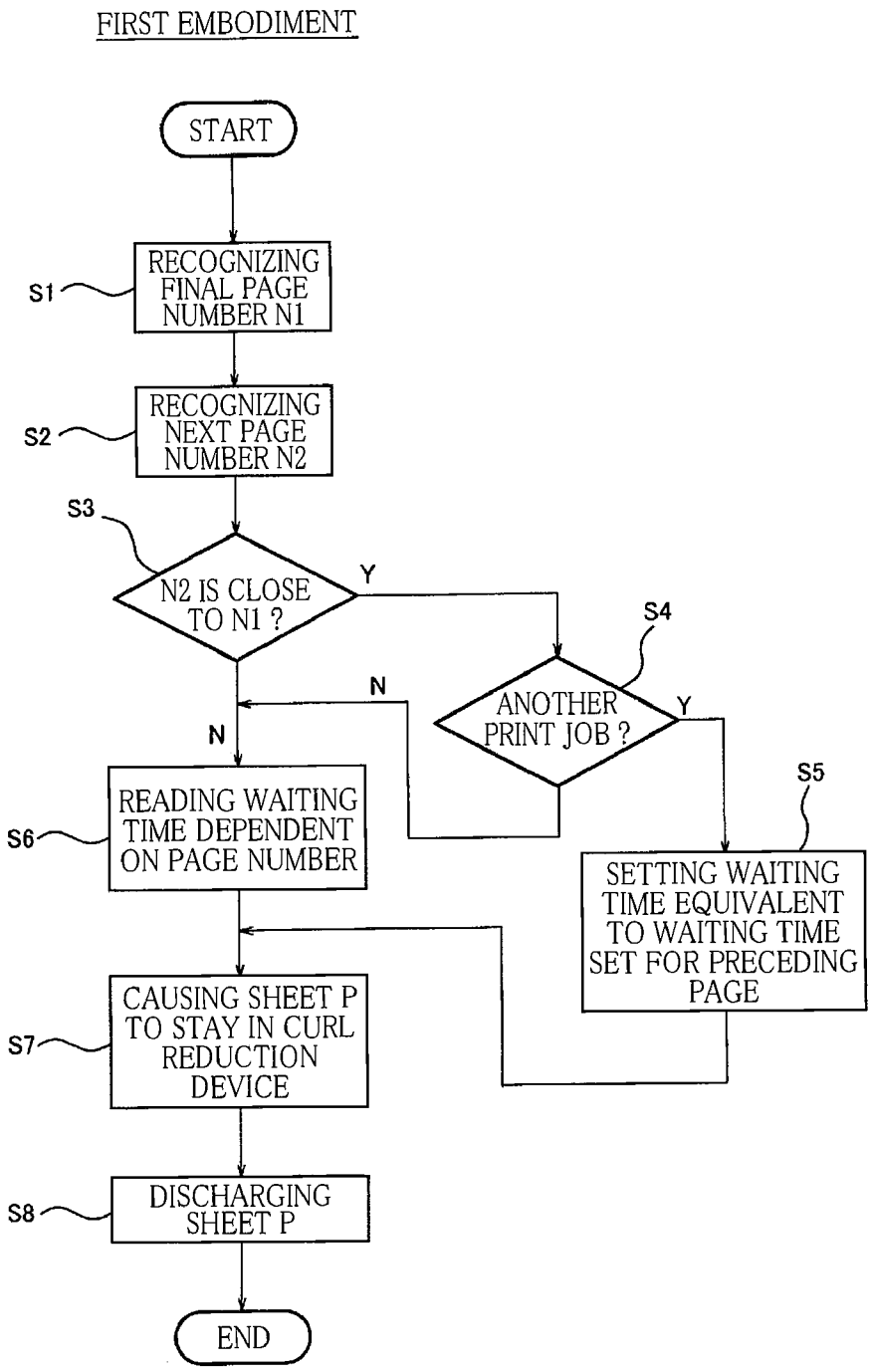
FIG. 6 is a flow chart showing an operation of the controller in a first embodiment of the invention.

The curl reduction elements will be described, by describing the waiting time as one of the curl reduction elements, for convenience of the description. FIG. 5 shows a waiting-time setting table T0 that is provided in the curl-reduction-element determining portion 82. In the waiting-time setting table T0, there are stored page numbers of the respective paper sheets which are contained in the print job and also values of the waiting time which are set for the respective page numbers. In the table T0, the value (whose unit is second) of the waiting time is increased with increase of the page number. It should be understood that the values of the waiting time in the table T0 of FIG. 5 are merely exemplary and not by way of limitation. Hereinafter, there will be specifically described operations of the controller 8 with reference to a flow chart of FIG. 6. In the present embodiment, the page number of the print data is represented by one of the parameters that are to be recognized by the parameter recognizing portion 81.

Each print job in its entirety from the front end to the rear end is temporarily stored in the storage portion 83, so that the storage portion 83 stores the image data set, i.e., a plurality of image data representing a plurality of images. The parameter recognizing portion 81 recognizes the number of paper sheets P that are to be subjected to image formations performed based on the print data set contained in the print job that is stored in the storage portion 83. That is, the parameter recognizing portion 81 recognizes a final page number N1 of the print data that is located in the rear end of the print job (at step S1). The final page number N1 is transmitted to the controlling portion 80.

Subsequently, the parameter recognizing portion 81 reads the print job from the storage portion 83, and recognizes a next page number N2 of paper sheet P that is to be next subjected to an image formation performed based on the print data (at step S2). Then, the controlling portion 80 judges whether or not the next page number N2 is close to the final page number N1, namely, whether or not the print data relating to the next page number N2 is located in a rear portion of the print job (at step S3). If the controlling portion 80 judges at step S3 that the next page number N2 is located in the rear portion of the print job, the controlling portion 80 obtains, from the parameter recognizing portion 81, information indicative of whether or not another print job will follow the print job that is currently executed (at step S4). If the controlling portion 80 judges at step S4 that there is another print job, the curl-reduction-element determining portion 82 is controlled by the controlling portion 80 to set a waiting time equivalent to that has been set for the page number located in a front portion of the print job although the next page number N2 is located in the rear portion of the print job (at step S5).

When there is another print job following the currently executed print job, even if the page number of the paper sheet P is located in the rear portion of the currently executed print job, other paper sheets P will be superposed on the paper sheet P in question, after the paper sheet P in question is subjected to an image formation and received in the exit tray 11. Therefore, in this case, a relative small length of time as the waiting time is set for the paper sheet P in question, for thereby reducing the throughput time.

If it is judged at step S3 that the next page number N2 is a value far from that of the final page number N1, namely, that the print data relating to the next page number N2 is located in the front portion of the print job, or if it is judged at step S4 that there is no further print job, the control flow goes to steps S6 and S7. The controlling portion 80 transmits, to the curl-reduction-element determining portion 82, the page number of paper sheet P which is recognized by the parameter recognizing portion 81. The curl-reduction-element determining portion 82 reads a value of the waiting time that is dependent on the page number of the paper sheet P, from the table that is provided in the curl-reduction-element determining portion 82 (at step S6), so as to cause the paper sheet P to stay in the curl reduction device 2 for a length of time that corresponds to the read value of the waiting time (at step S7). Specifically described, when the controlling portion 80 detects completion of an image formation performed on the paper sheet P on the basis of the print data, i.e., completion of ink ejection from the liquid ejection heads 4 to the paper sheet P, the curl-reduction-element determining portion 82 stops rotation of the motor M during the waiting time.

In the present embodiment, the curl-reduction-element determining portion 82 constitutes a waiting time determining portion.

As described above, in the table that is provided in the curl-reduction-element determining portion 82, the value of the waiting time is increased with increase of the page number. Accordingly, the curl-reduction-element determining portion 82 determines a longer waiting time for the paper sheet P whose page number is judged to be located in a rear portion of the print job, than the paper sheet P whose page number is judged to be located in a front portion of the print job. In other words, the waiting time for which an earlier one of the paper sheets P is caused to stay in the curl reduction device 2 is shorter than the waiting time for which a later one of the paper sheets P is caused to stay in the curl reduction device 2. The curl reduction device 2 stops rotation of the motor M such that the paper sheet P that has been subjected to an image formation is stopped in a given position in the curl reduction device 2 or on the guide 52, whereby the curl of the paper sheet P is removed or at least reduced.

When the waiting time has elapsed, the curl-reduction-element determining portion 82 restarts rotation of the motor M so as to convey the paper sheet P, whose curl has been reduced, to the exit tray 11 (at step S8).

In a case when the page number of the paper sheet P is located in a rear portion of the print job, the number of the paper sheets P which are to be superposed on the paper sheet P in question is small. That is, in this case, the small number of the paper sheets P are superposed on the paper sheet P in question, when being discharged to the exit tray 11. Therefore, the curl of the paper sheet P in question is difficult to be reduced. Further, a length of time from since the paper sheet P in question is discharged to the exit tray 11 until an user picks up the paper sheets P stacked on the exit tray 11, is short. This is also a factor that makes it difficult to reduce the curl of the paper sheet P in question. In view of the difficulty in reduction of the curl of the paper sheet P in question, the waiting time for the paper sheet P in question is set to a large value to increase the curl reduction degree.

In this case, if a long waiting time were set for every one of all the paper sheets P of page numbers contained in the print job, the throughput time would be considerably increased. Therefore, by setting a long waiting time exclusively for the paper sheets P of page numbers that are located in a rear portion of the print job, the increase of the throughput time is restrained.

As described above, the curl reduction elements includes not only the waiting time but also the heating time and heating temperature of the heater 20. Therefore, the curl reduction degree of the paper sheet P may be changed by changing the waiting time and also changing the heating time and/or temperature of the heater 20, so that the curl reduction degree is established by combination of a value of the waiting time and an operation of the heater 20. Further, the curl reduction degree may be changed by changing the heating time and/or temperature of the heater 20, in place of changing the waiting time. In this modification, for example, for increasing the curl reduction degree, it is possible to increase the temperature of the heater and/or an amount of the heated air supplied to the paper sheet P, without changing the waiting time.

Second Embodiment

The amount of curl caused in the paper sheet P after an image formation performed on the paper sheet P varies depending on kind of the paper sheet P. Specifically described, there is a difference between a thick paper sheet P and a thin paper sheet P with respect to the bending strength which is referred to as rigidity of the paper sheet P. Further, there is a difference between a high-quality paper sheet and a standard paper sheet with respect to the rigidity, even if there is no difference in thickness therebetween. A high-quality paper sheet has a low rigidity and is accordingly difficult to be curled. Meanwhile, a standard paper sheet has a high rigidity and is accordingly easy to be curled. Therefore, when the bending strength of the paper sheet P is large, it is necessary to increase the curl reduction degree, for example, by increasing the waiting time.

Figure 7:
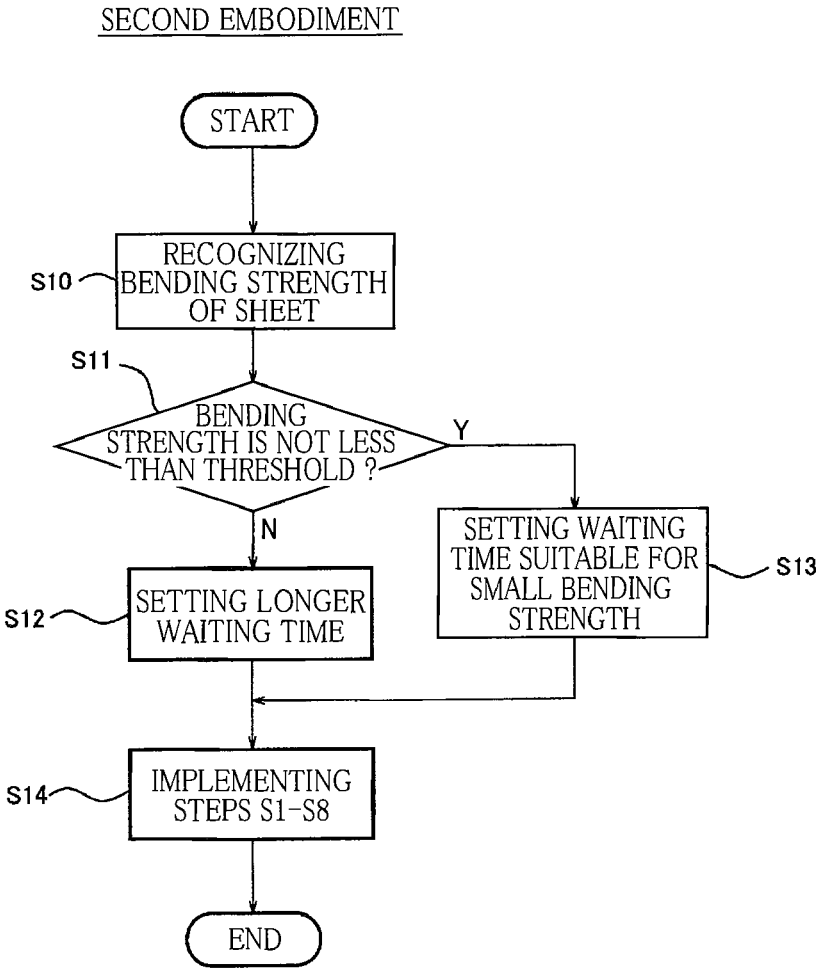
FIG. 7 is a flow chart showing an operation of the controller in a second embodiment of the invention.

When an user inputs, through the operating panel 12, data relating to the bending strength of the paper sheet P, the controller 8 changes the waiting time on the basis of the data relating to the bending strength, through a procedure as described below. That is, in the present embodiment, the bending strength of the paper sheet P is represented by one of the parameters that are to be recognized by the parameter recognizing portion 81. There will be described operations of the controller 8 in the present embodiment, with reference to a flow chart of FIG. 7. In the following description of the present embodiment, the waiting time as an example of the curl reduction element is determined depending on the bending strength of the paper sheet P. However, the heating time and/or the heating temperature of the heater 20 in place of the waiting time may be determined as the curl reduction elements, depending on the bending strength. Further, all of the waiting time, heating time and heating temperature may be used as the curl reduction elements in combination with one another.

FIG. 8 shows a table which is provided in the curl-reduction-element determining portion 82 and which has a first table T1 and a second table T2. The first table T1 stores values of the waiting time which are used for the paper sheet P having a low bending strength and which correspond to respective page numbers. The second table T2 stores values of the waiting time which are used for the paper sheet P having a high bending strength and which correspond to respective page numbers. In a case when the bending strength of the paper sheet P is high, the waiting time has to be long enough. Therefore, a value of the waiting time for the same page is larger in the second table T2 than in the first table T1. It should be understood that the values of the waiting time in the table of FIG. 8 are merely exemplary and not by way of limitation.

The parameter recognizing portion 81 recognizes the bending strength of the paper sheet P, from data inputted by an user (at step S10). The recognized bending strength is transmitted to the controlling portion 80. The controlling portion 80 judges whether the bending strength of the paper sheet P is not smaller than a threshold (that is stored as a predetermined value in the controlling portion 80) (at step S11). In the present embodiment, the controlling portion 80 constitutes a bending-strength judging portion.

If the controlling portion 80 judges at step S11 that the bending strength of the paper sheet P is not smaller than the threshold, the controlling portion 80 controls the curl-reduction-element determining portion 82 such that the waiting time is set to a value which is suitable for the paper sheet P having a high bending strength (at step S12), namely, which is larger than a value of the waiting time that is to be set in a case when the bending strength is low. The curl-reduction-element determining portion 82 reads a value of the waiting time from the second table T2, and sets the read value for the motor M, for thereby inhibiting rotation of the motor M for a length of time corresponding to the value of the waiting time.

If the controlling portion 80 judges at step S11 that the bending strength of the paper sheet P is smaller than the threshold, the controlling portion 80 controls the curl-reduction-element determining portion 82 such that the waiting time is set to a value which is suitable for the paper sheet P having a low bending strength (at step S13). The curl-reduction-element determining portion 82 reads a value of the waiting time from the first table T1, and sets the waiting time to the read value.

Thereafter, steps S1 through S8 are implemented (at step S14). That is, a value of the waiting time which is dependent on the page number is read from the first table T1 or second table T2, so as to cause the paper sheet P to stay in the curl reduction device 2 for a length of time that corresponds to the read value of the waiting time.

In a case when the bending strength of the paper sheet P is high, it takes a large length of time for sufficiently reducing the curl of the paper sheet P. Therefore, in such a case, the curl is intended to be sufficiently reduced, by setting a large length of time as the waiting time.

Third Embodiment

As described above, each image data of the print job contains a flag and a vector image data. The flag is indicative of whether the image is to be printed by a monochrome mode or a color mode. The vector image data is used for calculating sizes and quantity of the ink droplets to be ejected to a pixel area on the paper sheet P, such that the sizes and quantity of the ejected ink droplets are estimated based on the vector image data. When the image is to be printed by a monochrome mode, the image data does not require a large length of time to be processed so that the image formation is performed at a high speed. On the other hand, when the image to be printed by a color mode, the image data requires a large length of time to be processed so that the image formation is performed at a low speed. Further, when the quantity of ink droplets to be ejected onto the paper sheet P is small, the image formation is performed at a high speed.

Figure 9:
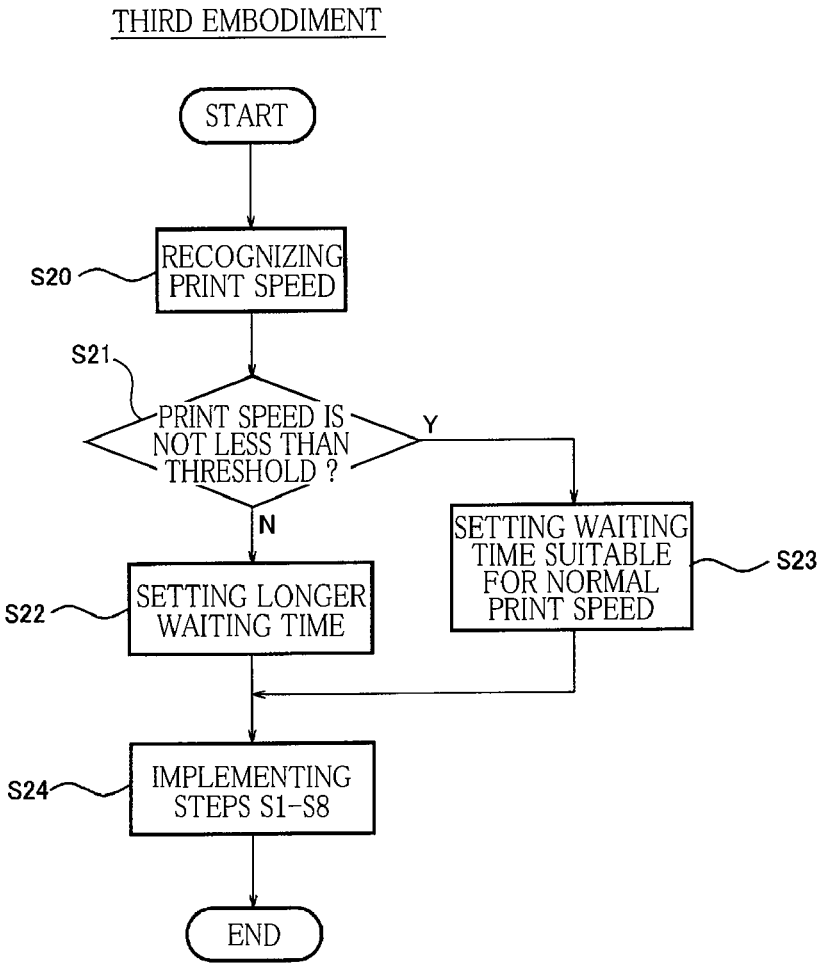
FIG. 9 is a flow chart showing an operation of the controller in a third embodiment of the invention.

When the image formation is performed at a high speed, a length of time from since the paper sheet P is discharged to the exit tray 11 until the next paper sheet P is discharged to the exit tray 11 is short, so that the curl of the paper sheet P is difficult to be sufficiently reduced by the curl reduction device 2. In the inkjet recording apparatus according to the present embodiment, it is judged whether the image formation is performed on the paper sheet P at a high speed or not. This judgment is made based on the image data contained in the print job. That is, in the present embodiment, the speed (hereinafter referred to as a printing speed) at which the image formation is to be performed on the paper sheet P, is represented by one of the parameters that are to be recognized by the parameter recognizing portion 81. There will be described operations of the controller 8 in the present embodiment, with reference to a flow chart of FIG. 9.

The curl-reduction-element determining portion 82 is provided with a table that has a third table T3 and a fourth table T4. The third table T3 stores values of the waiting time which are used for a case of a standard printing speed and which correspond to respective page numbers. The fourth table T4 stores values of the waiting time which are used for a case of a high printing speed and which correspond to respective page numbers. The third and fourth tables T3, T4 are substantially identical with the respective first and second tables T1, T2 of FIG. 8. That is, the waiting time values stored in the third and fourth tables T3, T4 are substantially the same as those stored in the first and second tables T1, T2. In the case of a high printing speed, the curl is unlikely to be sufficiently reduced in a period of time since a paper sheet P is discharged to the exit tray 11 until the next paper sheet P is discharged to the exit tray 11, so that the waiting time has to be longer than in the case of a standard printing speed.

The parameter recognizing portion 81 recognizes the printing speed for the paper sheet P, from the flag and vector image data contained in the image data in the print job (at step S20). The recognized printing speed is transmitted to the controlling portion 80. The controlling portion 80 judges whether the printing speed for the paper sheet P is not lower than a threshold (that is stored as a predetermined value in the controlling portion 80) (at step S21). If the controlling portion 80 judges at step S21 that the printing speed for the paper sheet P is not lower than the threshold, the controlling portion 80 controls the curl-reduction-element determining portion 82 such that the waiting time is set to a value which is suitable for the case of a high printing speed (at step S22), namely, which is larger than a value of the waiting time that is to be set in the case of a standard printing speed. The curl-reduction-element determining portion 82 reads a value of the waiting time from the second table T4, and sets the waiting time to the read value.

If the controlling portion 80 judges at step S21 that the printing speed for the paper sheet P is lower than the threshold, the controlling portion 80 controls the curl-reduction-element determining portion 82 such that the waiting time is set to a value which is suitable for the case of a standard printing speed (at step S23). The curl-reduction-element determining portion 82 reads a value of the waiting time from the third table T3, and sets the waiting time to the read value.

Thereafter, steps S1 through S8 are implemented (at step S24). That is, a value of the waiting time which is dependent on the page number is read from the third table T3 or fourth table T4, so as to cause the paper sheet P to stay in the curl reduction device 2 for a length of time that corresponds to the read value of the waiting time.

As described above, in the case when the printing speed is high, the waiting time is set to a value larger than in the case of the standard printing speed. This larger values is a length of time which is large enough to sufficiently reduce the curl and which does not lead to a considerable increase of the throughput time.

Fourth Embodiment

As described above, each image data of the print job contains the vector image data that serves a reference based on which it is possible to calculate the sizes and quantity of the ink droplets to be ejected to a pixel area on the paper sheet P. An ink ejection data can be generated by converting the vector image data to a raster image data. FIG. 10 is a set of views showing the ink ejection data for each color ink. The ink ejection data represents the sizes and quantities of the ink droplets to be ejected to each one of blocks or pixel areas that are virtually defined on the paper sheet P. In the views (a)-(d) of FIG. 10, "L", "M" and "S" represents sizes of the ink droplets, specifically, "L" represents a large-sized droplet, "M" represents a medium-sized droplet, and "S" represents a small-sized droplet. As described above, the ink ejection data is prepared for each of color inks, i.e., black, cyan, magenta and yellow inks. In FIG. 4, the view (a) shows the ink ejection data for the black ink, the view (b) shows the ink ejection data for the cyan ink, the view (c) shows the ink ejection data for the magenta ink, and the view (d) shows the ink ejection data for the yellow ink.

An amount of the ink droplets of the four color inks to be ejected to each of the blocks or pixel areas are calculated, on the basis of the sizes of the respective ink droplets and the quantity of the ink droplets, specifically, by multiplying the size of each ink droplets by the quantity of the ink droplets. Then, a total amount of the inks to be ejected to an entirety of the paper sheet P can be obtained, by summing the amounts of the ink droplets to be ejected to all of the blocks or pixel area. When the total amount of the ejected ink droplets (hereinafter referred to as an ink ejection amount) is large, there is a need to sufficiently dry inks so as to restrain the curl amount. On the other hand, when the ink ejection amount is small, the inks are dried rapidly.

Figure 11:
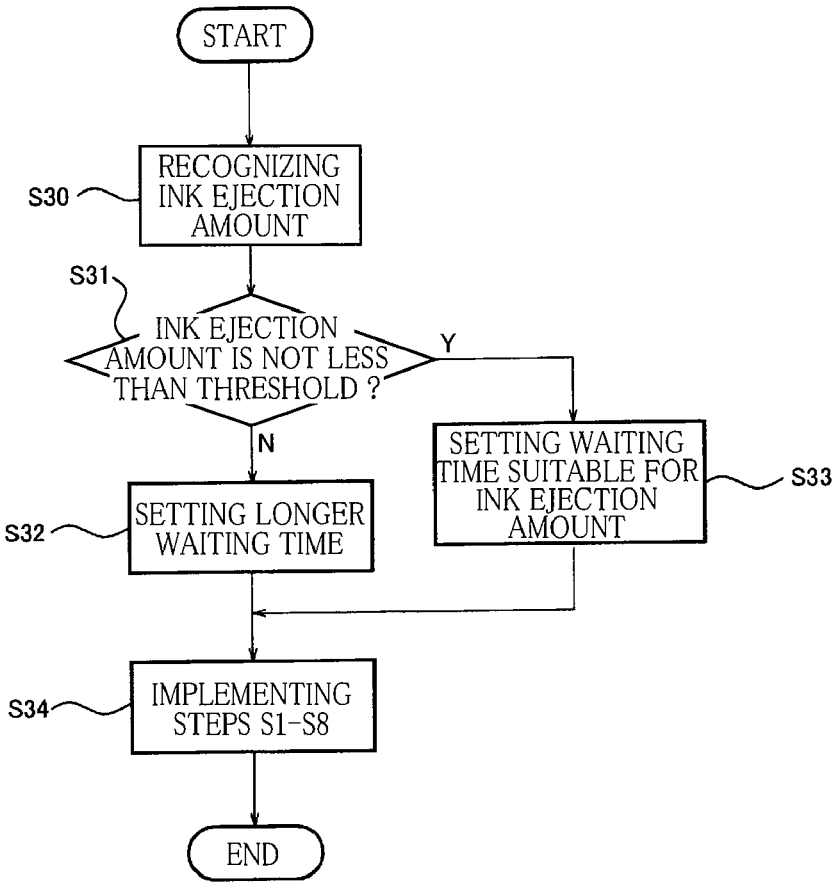
FIG. 11 is a flow chart showing an operation of the controller in a fourth embodiment of the invention.

In the inkjet recording apparatus according to the present embodiment, it is judged whether the ink ejection amount for the paper sheet P is large or small. This judgment is made based on the image data contained in the print job. That is, in the present embodiment, the ink ejection amount for the paper sheet P is represented by one of the parameters that are to be recognized by the parameter recognizing portion 81. There will be described operations of the controller 8 in the present embodiment, with reference to a flow chart of FIG. 11.

The curl-reduction-element determining portion 82 is provided with a table that has a fifth table T5 and a sixth table T6. The fifth table T5 stores values of the waiting time which are used for a case when the ink ejection amount is small, and which correspond to respective page numbers. The sixth table T6 stores values of the waiting time which are used for a case when the ink ejection amount is large, and which correspond to respective page numbers. The fifth and sixth tables T5, T6 are substantially identical with the respective first and second tables T1, T2 of FIG. 8.

In the case when the ink ejection amount for the paper sheet P is large, since there is a need to sufficiently dry inks so as to restrain the curl amount, the waiting time has to be longer than in the case when the ink ejection amount for the paper sheet P is small. Therefore, a value of the waiting time for the same page is larger in the sixth table T6 than in the fifth table T5.

The parameter recognizing portion 81 is provided at its input side with an ink-ejection-data generating portion (not shown) that is configured to generate the ink ejection data by converting the vector image data (that is contained in the image data in the print job) to the raster image data. That is, the print job is inputted to the ink-ejection-data generating portion whereby the vector image data contained in the image data is converted to the raster image data.

The parameter recognizing portion 81 receives the raster image data inputted thereto, and recognizes the ink ejection amount for the paper sheet P on the basis of the raster image data (at step S30). As described above, the ink ejection amount can be obtained, by summing the amounts of the ink droplets ejected to all of the blocks after calculating the amount of the ink droplets ejected to each of the blocks. The recognized ink ejection amount is transmitted to the controlling portion 80. The controlling portion 80 judges whether the ink ejection amount for the paper sheet P is not smaller than a threshold (that is stored as a predetermined value in the controlling portion 80) (at step S31). In the present embodiment, the controlling portion 80 constitutes a liquid-ejection-amount judging portion.

If the controlling portion 80 judges at step S31 that the ink ejection amount for the paper sheet P is not smaller than the threshold, the controlling portion 80 controls the curl-reduction-element determining portion 82 such that the waiting time is set to a value which is suitable for a case when the ink ejection amount is large (at step S32), namely, which is larger than a value of the waiting time that is to be set in a case when the ink ejection amount is small. The curl-reduction-element determining portion 82 reads a value of the waiting time from the sixth table T6, and sets the waiting time to the read value.

If the controlling portion 80 judges at step S31 that the ink ejection amount for the paper sheet P is smaller than the threshold, the controlling portion 80 controls the curl-reduction-element determining portion 82 such that the waiting time is set to a value which is suitable for the case when the ink ejection amount is small (at step S33). The curl-reduction-element determining portion 82 reads a value of the waiting time from the fifth table T5, and sets the waiting time to the read value. Thereafter, steps S1 through S8 are implemented (at step S34). That is, a value of the waiting time which is dependent on the page number is read from the fifth table T5 or sixth table T6, so as to cause the paper sheet P to stay in the curl reduction device 2 for a length of time that corresponds to the read value of the waiting time.

In the case when the ink ejection amount for the paper sheet P is large, it takes a large length of time to sufficiently reduce the curl of the paper sheet P. Therefore, in this case, the waiting time is set to a large value, so as to sufficiently reduce the curl.

In the present embodiment, the controlling portion 80 compares the ink ejection amount for the paper sheet P with the threshold. However, the controlling portion 80 may compare an ink receiving area on the paper sheet P (i.e., an area on the paper sheet P on which the inks are received) with a threshold that is stored as a predetermined value in the controlling portion 80. The ink receiving area on the paper sheet P can be obtained by summing ink receiving areas on all of the blocks after obtaining an ink receiving area on each of the blocks.

Further, even if the ink ejection amount for the entirety of the paper sheet P is the same, the curl amount of the paper sheet P varies depending on variation in distribution of the inks onto the paper sheet P. Specifically, the curl amount of the paper sheet P in a case when large amounts of the ink droplets are ejected to an edge portion of the paper sheet P while small amounts of the ink droplets are ejected to a central portion of the paper sheet P, is different from that in a case when small amounts of the ink droplets are ejected to the edge portion of the paper sheet P while large amount of the ink droplets are ejected to the central portion of the paper sheet P. In general, the curl amount is large when large amounts of the ink droplets are ejected to an edge portion of the paper sheet P, so that the waiting time has to be set to a larger value in the above-described former case than in the above-described later case. In view of this, the waiting time may be preliminarily set to an approximate value simply based on the ink ejection amount for the entirety of the paper sheet P, and then may be eventually set to a definitive value by taking account of also a weighting that is dependent on a position of each block or pixel area on the paper sheet P, for example, such that a larger weight is given to the amount of the ink droplets ejected to the blocks or pixel areas that are located in the edge portion of the paper sheet P.

In the above-described embodiments, the recording medium is constituted, by way of example, a paper sheet P. However, the present invention is applicable also to a case where the recording medium is constituted by other sheet such as a film or a label. That is, the recording medium may be any one of various of media, as long as a curl is caused therein when a liquid is applied thereto.

Further, in the above-described embodiments, the controlling portion 80 includes the curl-reduction-element determining portion 82 (see FIG. 3). However, instead, the controlling portion 80 and the curl-reduction-element determining portion 82 may be constituted by respective portions which are other than each other and which are connected to each other.

Further, in the above-described embodiments, data relating to the bending strength of the paper sheet P is inputted by an user through the operating panel 12. However, instead, it is possible to employ an arrangement in which a plurality of sheet supply trays 60 are provided such that each of the sheet supply trays 60 stores a corresponding one of different types of paper sheets P having different bending strengths. In this arrangement, each of the sheet supply trays 60 has, in its outer surface, an identification mark or the like that represents the corresponding type of paper sheets P that are stored in the sheet supply tray 60, so that the type of the stored paper sheets P can be identified by a reading device that is provided in the housing body 10.

When any one of the sheet supply trays 60 is received in the housing body 10, the identification mark is read by the reading device and the type of the stored paper sheets P can be identified, so that data relating to the bending strength of the stored paper sheets P is automatically obtained, namely, so that the bending strength of the stored paper sheets P is automatically recognized. The identification mark may be constituted, for example, by a two-dimensional code or a concavoconvex provided on an outer surface of the sheet supply tray 60. The reading device may be constituted, for example, by a two-dimensional code reader or a switch or the like that is configured to detect the concavoconvex of the sheet supply tray 60.

In the above-described embodiments, as shown in FIG. 5, the value (whose unit is second) of the waiting time is increased with increase of the page number. However, it is also possible to employ an arrangement in which the waiting time is set to a constant value (e.g., 0.5 seconds) for the paper sheets P from a first page to a given numbered page (e.g., to page four), and set to another value (e.g., 0.8 seconds) that is larger than the constant value, for the paper sheets P of pages following the given numbered page.

Further, in a case when the quantity of paper sheets to be subjected to image formations is small, namely, in case when an effect of reduction of the curl owing to weights of the paper sheets cannot be expected, the curl reduction degree (e.g., the waiting time) may be set to a constant value that is suitable for a sufficient reduction of the curl, although the curl reduction degree may be controlled to vary in a case when the quantity of paper sheets (i.e., pages contained in the print job) is larger than a given number.

Moreover, in the above-described embodiments, the controller 8 may be constituted by a single CPU, a plurality of CPUs, a particular ASIC (Application Specific Integrated Circuit) or a combination of CPU and a particular ASIC.

The present invention is useful for a liquid ejection apparatus including a curl reduction device that is configured to remove or at least reduce curl caused in a recording medium having been subjected to an image formation.

What is claimed is:

1. A liquid ejection apparatus comprising:

a storage device configured to store therein an image data set representing a plurality of images that are to be formed on a plurality of recording media;

a liquid ejection head configured to perform an image formation on each of the plurality of recording media, so as to form, on the recording media, the respective images represented by the image data set that is stored in said storage device;

a curl reduction device configured to reduce curl caused in each of the recording media having a corresponding one of the images that has been formed thereon by said liquid ejection head;

an output tray configured to receive therein each of the recording media whose curl has been reduced by said curl reduction device, such that the received recording media are stacked on said output tray; and a control device configured to control said curl reduction device, such that the curl caused in an earlier one of the recording media is reduced by a smaller degree than the curl caused in a later one of the recording media that has been subjected to the image formation later than said earlier one of the recording media, wherein said control device is configured to determine a waiting time for which each of the recording media is caused to stay in said curl reduction device, the waiting time for which said earlier one of the recording media is caused to stay in said curl reduction device being shorter than the waiting time for which said later one of the recording media is caused to stay in said curl reduction device, and wherein said control device is configured to control said curl reduction device such that said curl reduction device is caused to reduce the curl of each of the recording media by causing each of the recording media to stay in said curl reduction device for the waiting time.

2. The liquid ejection apparatus according to claim 1, wherein said control device is configured to judge whether or not a bending strength of each of the recording media is smaller than a given threshold, and wherein said control device is configured to determine a larger length of time as the waiting time for each of the recording media in a case when the bending strength of said each of the recording media is not smaller than the given threshold, than in a case when the bending strength of said each of the recording media is smaller than the given threshold.

3. The liquid ejection apparatus according to claim 1, wherein said control device is configured to determine a larger length of time as the waiting time for each of the recording media in a case when a corresponding one of the images is formed on said each of the recording media at a speed that is not lower than a given threshold, than in a case when the corresponding one of the images is formed on said each of the recording media at a speed that is lower than the given threshold.

4. The liquid ejection apparatus according to claim 1, wherein said control device is configured to judge whether or not an amount of a liquid that is ejected by said liquid ejection head onto each of the recording media is smaller than a given threshold, and wherein said control device is configured to determine a larger length of time as the waiting time for each of the recording media in a case when the amount of the liquid ejected onto said each of the recording media is not smaller than the given threshold, than in a case when the amount of the liquid ejected onto said each of the recording media is smaller than the given threshold.

5. The liquid ejection apparatus according to claim 1, wherein said control device is configured to control said liquid ejection head such that the plurality of images are formed successively on the respective recording media, in accordance with a plurality of image-formation jobs each of which contains the image data set representing the plurality of images.

6. The liquid rejection apparatus according to claim 5, wherein said storage device is configured to store the plurality of image-formation jobs so as to store therein the image data set that is contained in each of the image-formation jobs.

7. The liquid ejection apparatus according to claim 1, wherein said curl reduction device includes a conveying device configured to convey each of the recording media having a corresponding one of the images formed thereon, while maintaining a shape of said each of the recording media.

8. The liquid ejection apparatus according to claim 1, wherein said curl reduction device includes a drying device configured to dry each of the recording media having a corresponding one of the images formed thereon, while maintaining a shape of said each of the recording media.

9. A curl reduction method that is to be executed in a liquid ejection apparatus comprising: (a) a storage device configured to store therein an image data set representing a plurality of images that are to be formed on a plurality of recording media; (b) a liquid ejection head configured to perform an image formation on each of the plurality of recording media, so as to form, on the recording media, the respective images represented by the image data set that is stored in said storage device; (c) a curl reduction device configured to reduce curl caused in each of the recording media having a corresponding one of the images that has been formed thereon by said liquid ejection head; and (d) an output tray configured to receive therein each of the recording media whose curl has been reduced by said curl reduction device, such that the received recording media are stacked on said output tray, said curl reduction method comprising:

specifying which one of the recording media corresponds to an earlier one of the recording media that is to be subjected to the image formation earlier than a later one of the recording media;

specifying which one of the recording media corresponds to said later one of the recording media that is subjected to the image formation later than said earlier one of the recording media;

controlling said curl reduction device, such that the curl caused in said earlier one of the recording media is reduced by a smaller degree than the curl caused in said later one of the recording media;

determining a waiting time for which each of the recording media is caused to stay in said curl reduction device, the waiting time for which said earlier one of the recording media is caused to stay in said curl reduction device being shorter than the waiting time for which said later one of the recording media is caused to stay in said curl reduction device, and controlling said curl reduction device such that said curl reduction device is caused to reduce the curl of each of the recording media by causing each of the recording media to stay in said curl reduction device for the waiting time.

10. A non-transitory computer-readable storage medium storing computer-readable instructions therein that, when executed by a processor of a liquid ejection apparatus comprising: (a) said processor, (b) a storage device configured to store therein an image data set representing a plurality of images that are to be formed on a plurality of recording media;

(c) a liquid ejection head configured to perform an image formation on each of the plurality of recording media, so as to form, on the recording media, the respective images represented by the image data set that is stored in said storage device; (d) a curl reduction device configured to reduce curl caused in each of the recording media having a corresponding one of the images that has been formed thereon by said liquid ejection head! and (e) an output tray configured to receive therein each of the recording media whose curl has been reduced by said curl reduction device, such that the received recording media are stacked on said output tray, cause the liquid ejection apparatus to execute the steps of specifying which one of the recording media corresponds to an earlier one of the recording media that is to be subjected to the image formation earlier than a later one of the recording medial specifying which one of the recording media corresponds to said later one of the recording media that is subjected to the image formation later than said earlier one of the recording media; and controlling said curl reduction device, such that the curl caused in said earlier one of the recording media is reduced by a smaller degree than the curl caused in said later one of the recording media;

determining a waiting time for which each of the recording media is caused to stay in said curl reduction device, the waiting time for which said earlier one of the recording media is caused to stay in said curl reduction device being shorter than the waiting time for which said later one of the recording media is caused to stay in said curl reduction device, and controlling said curl reduction device such that said curl reduction device is caused to reduce the curl of each of the recording media by causing each of the recording media to stay in said curl reduction device for the waiting time.

* * * * *